US005102053A

United States Patent [19]

Linder et al.

[11] Patent Number: 5,102,053

[45] Date of Patent: Apr. 7, 1992

[54] DEVICE FOR A COMBINED BLOWOUT OF FUEL AND AIR FOR FUEL INJECTION SYSTEMS IN INTERNAL COMBUSTION ENGINES

[75] Inventors: Ernst Linder; Hans Schlembach, both of Muehlacker, Fed. Rep. of Germany

[73] Assignee: Robert Bosch GmbH, Stuttgart, Fed. Rep. of Germany

[21] Appl. No.: 731,389

[22] Filed: Jul. 17, 1991

Related U.S. Application Data

[63] Continuation of Ser. No. 521,488, May 10, 1990, abandoned.

[30] Foreign Application Priority Data

Jul. 27, 1989 [DE] Fed. Rep. of Germany ..... 3924851

[51] Int. Cl.[5] ..... B05B 7/06

[52] U.S. Cl. ..... 239/412; 239/417.3; 239/585.3

[58] Field of Search ..... 239/416.4, 416.5, 417.3, 239/585, 423, 424, 412

[56] References Cited

U.S. PATENT DOCUMENTS 494,591 4/1893 North ..... 239/417.3
2,046,592 7/1936 Tracy ..... 239/417.3 X
4,040,569 8/1977 Knapp ..... 239/467
4,836,453 6/1989 Poehlman ..... 239/417.3 X

FOREIGN PATENT DOCUMENTS 507810 11/1954 Canada ..... 239/453
86/00960 8/1984 World Int. Prop. O. .

*Primary Examiner*—Andres Kashnikow
*Assistant Examiner*—Kevin P. Weldon
*Attorney, Agent, or Firm*—Edwin E. Greigg; Ronald E. Greigg

[57] ABSTRACT

A device for a combined blowout of fuel and air for fuel injection systems in internal combustion engines having a housing with fuel and air connections and a hollow, elongated housing neck having a blowout opening on an end that communicates with the fuel and air connection. Disposed on an end of the housing neck is an electromagnetically actuated valve element, which is pressed onto a valve seat by a valve closing spring. To make the device more efficient for fuel preparation, the valve seat is disposed on a coaxial inner tube that penetrates the housing neck and which extends into the blowout opening. The outer diameter of the inner tube is smaller than the inside diameter of the housing neck. The interior of the inner tube communicates with the fuel connection and the annular chamber enclosed by the inner tube and the housing neck communicates with the air connection.

13 Claims, 2 Drawing Sheets

DEVICE FOR A COMBINED BLOWOUT OF FUEL AND AIR FOR FUEL INJECTION SYSTEMS IN INTERNAL COMBUSTION ENGINES

This is a continuation of copending application Ser. No. 07/521,488 filed on May 10, 1990, now abandoned.

BACKGROUND OF THE INVENTION

The invention is based on a device for a combined blowout of fuel and air for fuel injection systems in internal combustion engines of the type defined hereinafter.

Such blowout devices are used for improved mixture preparation, by improving fuel atomization, with a high relative speed between the fuel and air. The atomized fuel is blown into the intake tube leading to the engine cylinder and is thereby well mixed with the combustion air supplied to the cylinder.

In a blowout device of this type (International Application WO 86/00960), an electromagnetically actuated valve element controls the blowout opening at the end of the housing neck. The valve element is mounted on a rod actuated by the electromagnet and is pressed onto the associated valve seat by a valve closing spring engaging the rod. A mixing chamber that communicates with the fuel connection is formed upstream of the valve element. A second valve element is mounted on the rod upstream of the mixing chamber and controls the supply of air to the mixing chamber. When the electromagnet is excited, both valves are opened simultaneously. As a result, air and fuel flow into the mixing chamber, at a ratio determined by the various pressure and flow cross sections; from there the fuel-air mixture flows into the engine intake tube.

OBJECT AND SUMMARY OF THE INVENTION

The device according to the invention for a combined blowout of fuel and air for fuel injection systems of internal combustion engines, has an advantage that because of an elongated housing neck and because of a valve, disposed on an end of the neck, that controls fuel metering and is surrounded by an annular blowout opening for the atomization air, the fuel and the atomizing air are delivered separately to near the inlet valve of the engine, and the two media are mixed together immediately upstream of the inlet valve. This assures not only good atomization and preparation of the mixture but also short idle times. The pressures of the air and fuel can be lowered, which means smaller pumps can be used. The housing neck, which is quite small in diameter, presents only slight flow resistance to the combustion air flowing into the inlet valve. Films of fuel on the intake tube wall, which increase both consumption and emissions, are greatly reduced or even avoided entirely. The overall result is better fuel preparation efficiency.

A preferred embodiment of the invention provides that the magnet armature of the electromagnet is embodied as a free-floating plate, which is engaged by a valve closing spring supported on the housing, and the valve element is secured on the plate by a steel wire extending in the interior of the inner tube; in this way, an extremely small housing neck diameter can be attained, which means even less flow resistance in the intake tube.

In a preferred embodiment of the invention, a valve seat cooperating with the valve element is disposed on the face end of the inner tube, with an annular seat face extending approximately transversely to the tube axis. This diverts the fuel at right angles to the flowing air, causing a pronounced shear flow between the fuel and the air flowing out at high speed, which produces very good fuel atomization.

In a further embodiment of the invention, a valve element is embodied as a valve plate, on which a throttle tang protruding into the inner tube is concentrically secured; along with the inner wall of the inner tube, the throttle tang defines an annular throttle gap. The valve plate stroke is kept long enough that despite any changes in length caused by thermal expansion, it is assured that the throttling will take place not in the valve seat but rather at the throttle gap of the throttle tang. The throttle tang is conically embodied, and the face end having the smaller diameter is remote from the valve plate. The conical embodiment of the throttle tang, because of the flow forces acting upon it, provides centering of the valve element, and as a result greatly reduces friction. The overall result is a low-mass, friction-free valve element.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
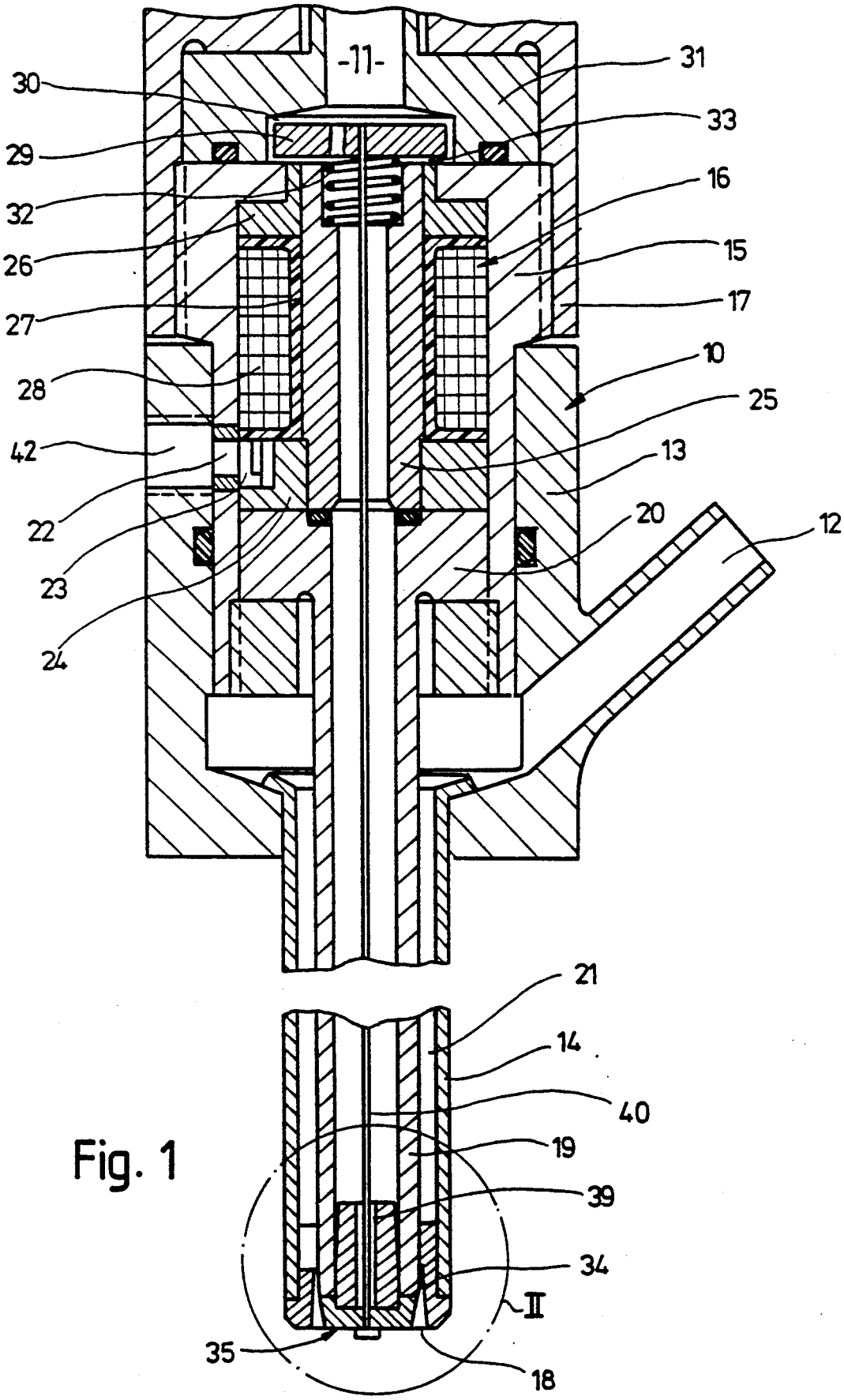
FIG. 1 is a longitudinal section through a blow-out device for a fuel injection system for internal combustion engines.

In FIG. 1, the device for a combined blow-out of fuel and air for fuel injection systems in internal combustion engines is shown in longitudinal section. It is used for metering fuel and for atomizing and blowing out the atomized fuel into the intake tube of the engine, directly at the intake valve. The device has a housing 10 with a fuel connection 11 and an air connection 12. The housing 10 is embodied in multiple parts and has a middle part 13, which carries the air connection 12, which is made of an electrically insulating material, for instance made of plastic. An elongated, hollow housing neck 14 is inserted into the air connection of the middle part 13 and protrudes from the bottom and has a very high ratio of length to diameter. A housing insert 15 is inserted into the middle part 13 from above and receives an electromagnet 16. A rotationally symmetrical T-piece 31 rests with its crossbar on the housing insert 15 and coaxially contains the fuel connection 11; and a cap part 17 is screwed onto the housing insert 15, thereby firmly tightening the T-piece 31. The housing neck 14, which has a blowout opening 18 on its free end, has a coaxial inner tube 19 inserted into it. The coaxial inner tube penetrates the entire housing neck 14 and extends from the inside of the blowout opening 18. In the housing interior, the inner tube 19 is fastened in place between the middle part 13 and the housing insert 15 by means of an integrally formed-end flange 20. The inner tube 19 has an outer diameter that is smaller than the inside diameter of the housing neck 14, so that an annular space 21 that communicates with the air connection 12 is formed between the inner tube 19 and the housing neck 14. The interior of the inner tube 19 communicates with the fuel connection 11 via the interior of a sleeve 25 that rests coaxially with the inner tube 19 on the face end of the flange 20 and is made of magnetically conductive material. The sleeve 25 has a magnetically conductive intermediate ring 24 on one end and a magnetically non-conductive outer ring 26 of T-shaped cross section on the other end. Mounted on the sleeve 25 is a coil carrier 27, which is fastened in place between the intermediate ring 24 and the outer ring 26. The coil carrier 27 receives an exciter coil 28 of the electromagnet 16. The magnet armature of the electromagnet 16, which here is embodied as a free-floating ferromagnetic plate 29, is retained on the face end of the sleeve 25 and the housing insert 15. The plate 29 is located in a recess 30 of a spacer ring 31 fastened between the housing insert 15 and the cap part 17 and is lifted from the housing insert 15 and sleeve 25 by a restoring spring 32. A working air gap 33 remains between the face ends of the sleeve 25 and housing insert 15 on one side and the plate 29 on the other; the magnetically non-conductive outer ring 26 retained between the housing insert 15 and the sleeve 25 splits the air gap into two air gaps, thereby enabling dual utilization of the magnetic force acting upon the plate 29. The supply of current to the exciter coil 28 is effected via a contact screw, not shown, which is screwed into a threaded hole 42 in the middle part 13 and protrudes through bores 22, 23 in the housing insert 15 and in the intermediate ring 24, until reaching the connection lug of the exciter coil 28.

Figure 2:
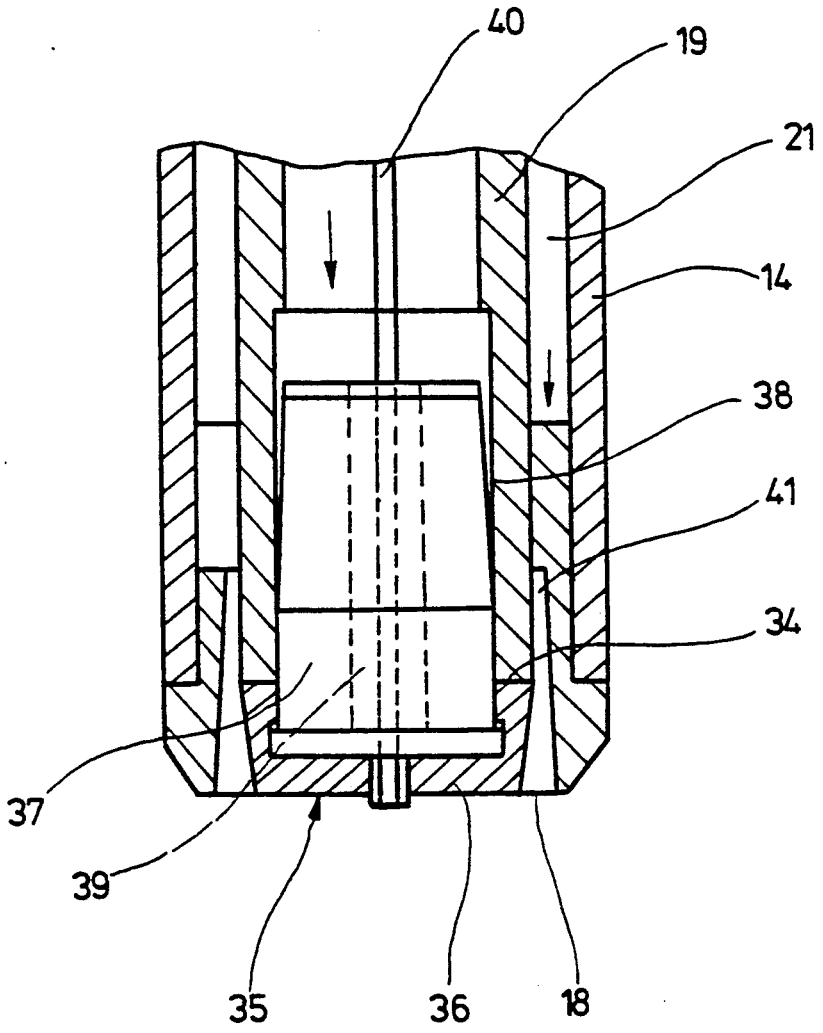
FIG. 2 is an enlarged view of the detail marked II in FIG. 1.

On the face end of the inner tube 19 protruding into the blowout opening 18, a valve seat 34 is disposed with an annular seat face oriented transversely to the tube axis. Cooperating with the valve seat 34 is a valve element 35, which has a valve plate 36 on which a throttle tang 37 protruding into the inner tube 19 is concentrically secured. Together with the inner wall of the inner tube 19, the throttle tang 37 defines an annular throttle gap 38 (FIG. 2). The throttle tang 37 is conically embodied; the face end of the throttle tang 37 having the smaller diameter is remote from the valve plate 36 and has a through bore 39. The valve element 35 is actuated by the electromagnet 16; to this end, the valve plate 36 is connected to the plate 29 via a steel wire 40, which passes through the through bore 39, the inner tube 19 and the sleeve 25. The connection of the steel wire 40 and the valve plate 36, or of the steel wire 40 and the plate 29, can for instance be done by laser welding. With the electromagnet 16 not excited, the restoring force acting upon the magnet armature (plate 29) presses the valve plate 36 onto the valve seat 34. When the electromagnet 36 is excited, the magnet armature is moved counter to the restoring spring 32, so that the valve plate 36 can be forced outwardly from the valve seat 34. The stroke of the magnet armature and the thus-defined stroke of the valve plate 36 is kept long enough that even upon changes in length of the steel wire 40 due to thermal expansion, it is assured that throttling of the fuel flow will take place not in the valve seat 34 but rather at the throttle gap 38. By means of the conical embodiment of the throttle tang 37, it is attained that the throttle tang 37 and valve plate 36 are centered by hydraulic forces, and thus the valve formed by the valve seat 34 and the valve element 35 operates largely without friction.

In the annular chamber 21 defined by the inner tube 19 and the housing neck 14, a throttle gap 41 is also formed, which is located directly upstream of the valve seat 34, in the direction of flow of the air in the annular chamber 21 (see FIG. 2). Metering of the outflowing air at a given inflow pressure can be attained by suitable design of the throttle gap 41.

If there is current to the exciter coil 28 of the electromagnet 16, then the electromagnet 16 is excited, and the plate 29 is attracted by the defined stroke, counter to the force of the restoring spring 32. By means of the fuel pressure in the interior of the inner tube 19, the valve plate 36 opens by the extent of this stroke, and fuel flows out, transversely to the direction of flow of the fuel emerging from the annular chamber 21 via the throttle gap 41. The result is a pronounced shear flow between the fuel and the air flowing out at high speed, which leads to very good atomization. The atomized fuel is blown out via the blowout opening 18 and along with the combustion air aspirated via the intake tube flows directly into the opened inlet valve of the engine.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A device for a combined blowout of fuel and air for fuel injection systems of internal combustion engines, having a housing, which has a fuel connection (11) and an air connection (12), a blowout opening that communicates with said fuel connection and said air connection, said blowout opening is embodied on an end of an elongated, hollow housing neck that has a very high ratio of length to diameter, and having a valve element (35) disposed on an end of the housing neck that is pressed onto a valve seat (34) by a valve closing spring (32) and is forced outward from the valve seat by means of an electromagnet (16) disposed in the housing, said electromagnet (16) has a magnet armature embodied as a free-floating plate (29), said free floating plate is engaged by said valve closing spring (32) supported on the housing, and that the plate (29) and the valve element (35) are connected to one another by means of a wire means (40) extending in an interior of an inner tube (19), said valve element (35) comprises a throttle tang (37) that protrudes into the inner tube (19) and defines an annular throttle gap (38) with the inside diameter of the inner tube (19) which is smaller than an annular channel formed between said wire means (40) and the inside diameter of the inner tube (19), said valve seat (34) is disposed on a face end of the inner tube (19) with an annular seat face extending approximately transversely through the tube axis, said inner tube (19) passes coaxially through the housing neck (14) and has an outer diameter that is smaller than the inside diameter of the housing neck (14) which forms as an annular chamber 21 therebetween, the inner tube (19) extends into the blowout opening (18) and the interior of the inner tube (19) communicates with the fuel connection (11), and said annular chamber (21) that is enclosed by the inner tube (19) and the housing neck (14) communicates with the air connection (12) whereby fuel and air are mixed as they flow through the blowout opening (18).

2. A device as defined by claim 1, in which said valve element (35) is embodied as a valve plate (36) on which said throttle tang (37) that protrudes into the inner tube (19) is concentrically secured.

3. A device as defined by claim 2, in which said throttle tang (37) is conically embodied, with its face end having the smaller diameter remote from the valve plate 36.

4. A device as defined by claim 3, in which said annular chamber (21) defined by the inner tube (19) and the housing neck (14), and an annular throttle gap (41) is embodied immediately upstream of the valve seat (34).

5. A device as defined by claim 1, in which said annular chamber (21) defined by the inner tube (19) and the housing neck (14), and an annular throttle gap (41) is embodied immediately upstream of the valve seat (34).

6. A device as defined by claim 2, in which said annular chamber (21) defined by the inner tube (19) and the housing neck (14), and an annular throttle gap (41) is embodied immediately upstream of the valve seat (34).

7. A device for a combined blowout of fuel and air for fuel injection systems of internal combustion engines, having a housing, which has a fuel connection (11) and an air connection (12), a blowout opening that communicates with said fuel connection and said air connection, said blowout opening is embodied on an end of an elongated, hollow housing neck (14) that has a very high ratio of length to diameter, and having a valve element (35) disposed on an end of the housing neck that is fixed to a wire means (40) and is pressed onto a valve seat (34) by a valve closing spring (32) and is forced outward from the valve seat by means of an electromagnet (16) disposed in the housing, said valve seat (34) is disposed on a face end of an inner tube (19) with an annular seat face extending approximately transversely to the tube axis, said valve element (35) is embodied as a valve plate (36) on which a throttle tang (37) that protrudes into the inner tube (19) is concentrically secured, which throttle tang, along with an inner wall of the inner tube (19), defines an annular throttle gap (38) through which fuel is forced, said annular throttle gap (38) is smaller than an annular channel formed between said wire means (40) and the inside diameter of the inner tube (19), said inner tube (19) passes coaxially through the housing neck (14) and has an outer diameter that is smaller than the inside diameter of the housing neck (14) which forms an annular chamber (21) therebetween, the inner tube (19) extends into the blowout opening (18) and the interior of the inner tube (19) communicates with the fuel connection (11), and said annular chamber (21) that is enclosed by the inner tube (19) and the housing neck (14) communicates with the air connection (12) whereby fuel and air are mixed as they flow through the blowout opening (18), said annular chamber (21) is defined by the inner tube (19) and the housing neck (14), and an annular throttle gap (41) is embodied immediately upstream of the valve seat (34).

8. A device as defined by claim 7, in which said throttle tang (37) is conically embodied, with its face end having the smaller diameter remote from the valve plate 36.

9. A device as defined by claim 8, in which said annular chamber (21) defined by the inner tube (19) and the housing neck (14), and an annular throttle gap (41) is embodied immediately upstream of the valve seat (34).

10. A device as defined by claim 7, in which said annular chamber (21) defined by the inner tube (19) and the housing neck (14), and an annular throttle gap (41) is embodied immediately upstream of the valve seat (34).

11. A device for a combined blowout of fuel and air for fuel injection systems of internal combustion engines, having a housing, which has a fuel connection (11) and an air connection (12), a blowout opening that communicates with said fuel connection and said air connection, said blowout opening is embodied on an end of an elongated, hollow housing neck that has a very high ratio of length to diameter, and having a valve element (35) disposed on an end of the housing neck that is pressed onto a valve seat (34) by a valve closing spring (32) and is forced outward from the valve seat by means of an electromagnet disposed in the housing, said valve seat (34) is disposed on an end of a coaxial inner tube (19) that passes coaxially through the housing neck (14) and has an outer diameter that is smaller than the inside diameter of the housing neck (14) which forms an annular chamber therebetween, the inner tube extends into the blowout opening (18) and the interior of the inner tube (19) communicates with the fuel connection (11), and said annular chamber (21) that is enclosed by the inner tube (19) and the housing neck (14) communicates with the air connection (12) whereby fuel and air are mixed as they flow through the blowout opening (18), said annular chamber (21) is defined by the inner tube (19) and the housing neck (14), and an annular throttle gap (41) is embodied downstream of said annular chamber (21) and immediate upstream of the valve seat (34) by throttle means attached on the end of the housing neck (14).

12. A device as defined by claim 11, in which said electromagnet (16) has a magnet armature embodied as a free-floating plate (29), said free floating plate is engaged by a valve closing spring (32) supported on the housing, and that the plate (29) and the valve element (35) are connected to one another by means of a wire means (40) extending in an interior of the inner tube (19).

13. A device as defined by claim 11, in which said valve seat (34) is disposed on a face end of the inner tube (19) with an annular seat face extending approximately transversely to the tube axis.

* * * * *